US008061542B2

(12) United States Patent
Poupore et al.

(10) Patent No.: US 8,061,542 B2
(45) Date of Patent: Nov. 22, 2011

(54) DRINKING BOTTLE ASSEMBLY

(75) Inventors: Timothy J. Poupore, Toronto (CA); Stacey Charlene Gay, Toronto (CA); Stephen Douglas Armstrong, Toronto (CA)

(73) Assignee: Murray Waters, Inc., Tampa, FL (US)

( * ) Notice: Subject to any disclaimer, the term of this patent is extended or adjusted under 35 U.S.C. 154(b) by 455 days.

(21) Appl. No.: 12/211,316

(22) Filed: Sep. 16, 2008

(65) Prior Publication Data

US 2010/0065525 A1 Mar. 18, 2010

(51) Int. Cl.

| | |
|---|---|
| ***B65B 7/28*** | (2006.01) |
| ***B65D 39/00*** | (2006.01) |
| ***B65D 41/00*** | (2006.01) |
| ***B65D 41/04*** | (2006.01) |
| ***B65D 43/00*** | (2006.01) |
| ***B65D 47/00*** | (2006.01) |

(52) U.S. Cl. ..... 215/44; 215/228; 215/252; 215/258; 215/316; 215/318; 215/329; 215/334; 215/400

(58) Field of Classification Search ..... 215/44, 215/228, 252, 258, 316, 318, 329, 334, 400
See application file for complete search history.

(56) References Cited

U.S. PATENT DOCUMENTS

| | | | | |
|---|---|---|---|---|
| 7,850,028 | B2 * | 12/2010 | Morini | 215/220 |
| 2007/0102389 | A1 * | 5/2007 | Hoepner et al. | 215/235 |
| 2009/0045224 | A1 * | 2/2009 | Faaborg et al. | 222/111 |
| 2009/0250469 | A1 * | 10/2009 | Heiberger | 220/378 |

* cited by examiner

*Primary Examiner* — Anthony Stashick
*Assistant Examiner* — Madison L Wright
(74) *Attorney, Agent, or Firm* — Warner Norcross & Judd LLP

(57) ABSTRACT

A drinking bottle assembly includes a bottle having a cavity for storing a fluid and a neck that forms an opening at a dispensing end of the bottle. A removable collar at least partially covers the bottle neck and provides a generally smooth outer surface for a person's mouth and lips to contact when drinking from the bottle. The collar includes a neck attachment for retaining the collar on the bottle. A removable cap can be selectively attached to the collar for opening and closing the bottle.

16 Claims, 4 Drawing Sheets

DRINKING BOTTLE ASSEMBLY

BACKGROUND OF THE INVENTION

The present invention relates to drinking bottles, and more particularly to closures for drinking bottles.

Plastic drinking bottles, such as water and soda bottles, have gained in popularity presumably in part because they provide a convenient way to transport beverages. Drinking bottles are typically reclosable and are formed from a lightweight plastic material. The bottles are therefore extremely portable, reclosable and provide access to beverages where such access may not otherwise be available.

Most drinking bottles have a removable threaded cap, which allows the user to easily twist the cap off of the bottle, take a drink, and twist the cap back on the bottle to close it. In such a configuration, threading is typically included on the inside of the cap and is arranged to correspond to threading on the outside of the neck of the bottle. Although the threaded connection between the cap and the bottle sufficiently seals the bottle to prevent fluid leakage, the neck of the bottle forms a drinking area and the presence of threads on the drinking area can create problems. More specifically, the positioning of the threads on the drinking area of the bottle results in a person's lips contacting the threaded surface when drinking. The threads can be uncomfortable and may create gaps between the lips and the bottle neck that cause the contents of the bottle to dribble when drinking.

SUMMARY OF THE INVENTION

The present invention provides a closure assembly for a drinking bottle in which the closure assembly provides a drinking area devoid of threads, snaps or other contoured attachment elements to provide a more comfortable drinking surface. The closure assembly may include a collar that is mounted over the bottle neck and a removable cap that is removably fitted to the collar for opening and closing the bottle.

In one embodiment, the collar includes an outer surface that forms a generally smooth drinking area and an internal neck attachment for securing the collar to the bottle neck. The collar may also include an internal cap attachment for removably securing the cap to the collar.

In one embodiment, the drinking bottle includes a cavity for storing a fluid and a threaded neck that forms an opening at a dispensing end of the bottle. A removable collar at least partially covers the threaded neck and provides a generally smooth outer surface for a person's mouth and lips to contact when drinking from the bottle. The collar includes a threaded inner surface that is interfitted with the threaded neck for retaining the collar on the bottle. A removable threaded cap can be selectively attached to another threaded portion on the inner surface of the collar for opening and closing the bottle.

Optionally, the collar may include a plurality of tabs that engage a lip on the bottle to resist the removal of the collar from the bottle. In one embodiment, the threaded portion of the inner surface of the collar can be twisted about the threaded neck of the bottle to move the collar onto the neck and to pull the tabs over the lip.

Optionally, the collar may include a flange extending from its inner surface and positioned between the neck attachment and the cap attachment. The flange may form a pocket for receiving the dispensing end of the bottle.

According to another aspect of the invention, a method of sealing a bottle is provided, including the steps of (a) providing a bottle for storing fluid, the bottle having a neck that defines an opening at a dispensing end of the bottle; (b) providing a collar adapted to at least partially cover the neck, the collar having an outer drinking surface and an inner surface adapted to be connected to the neck; (c) applying the collar to the neck; and (d) providing a removable cap for sealing the opening in the bottle and applying the cap to either the collar or the bottle.

Thus, the present invention provides a bottle that combines the convenience of a resealable cap with the comfort and aesthetically-pleasing look of a smooth collar. The removable cap can be easily twisted on and off of the collar to open and close the bottle as desired, yet the attachment portions on the collar are all positioned internally, such that the outer drinking area does not include any threads or other contoured attachment elements that may create gaps and cause the beverage to dribble when drinking. Further, the sealed connection between the removable cap and the collar ensures that fluid will not leak from the bottle when the cap is attached. The collar can also be selectively removed from the bottle, but may include additional features, such as tabs and the like, to prevent the unintentional removal of the collar from the bottle.

These and other objects, advantages, and features of the invention will be more fully understood and appreciated by reference to the description of the current embodiment and the drawings.

DESCRIPTION OF THE CURRENT EMBODIMENT

Figure 1:
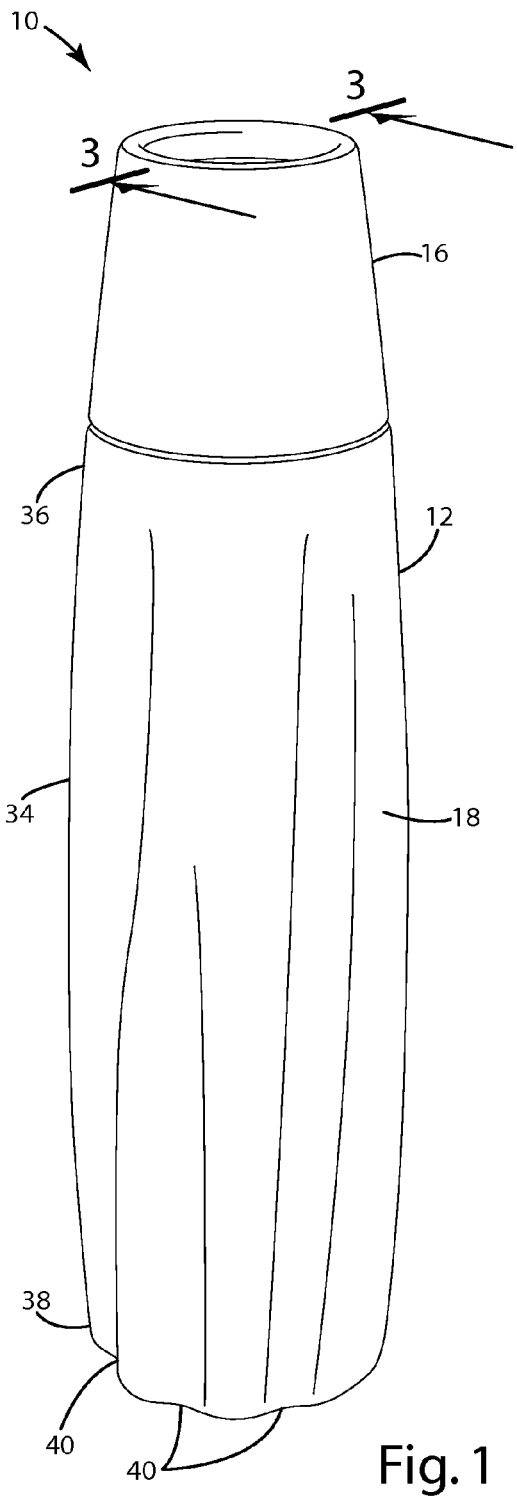
FIG. 1 is a perspective view of a drinking bottle assembly in accordance with the present invention.
Figure 2:
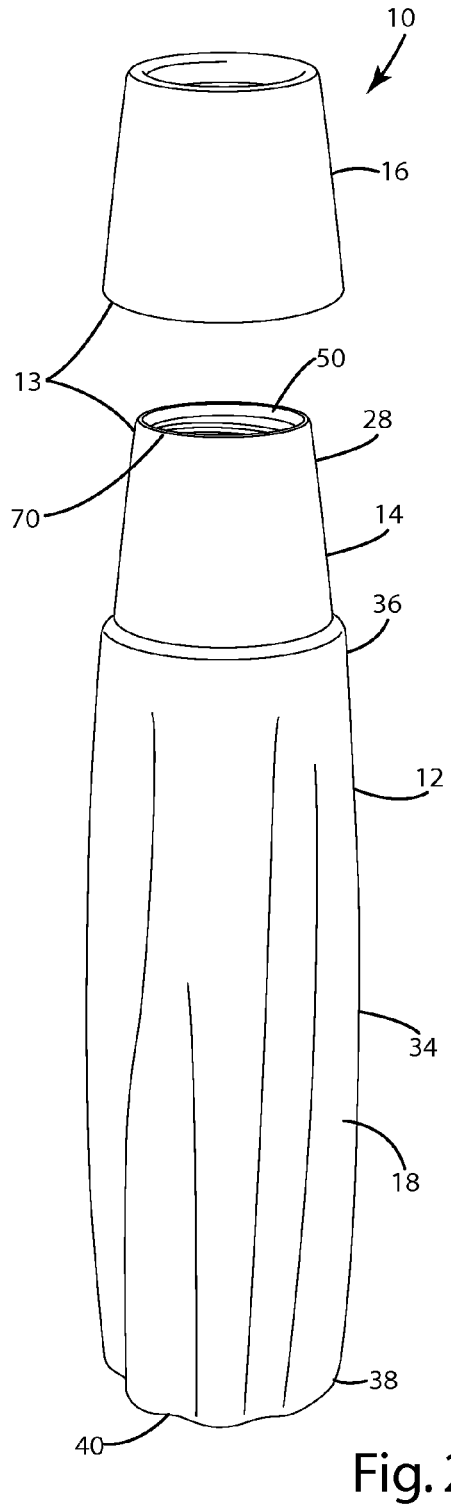
FIG. 2. is a perspective view of the drinking bottle assembly with the cap removed.

A drinking bottle assembly according to the present invention is shown in FIG. 1 and is generally designated 10. The drinking bottle assembly 10 includes a bottle 12 and a cap assembly 13 that includes a removable collar 14 and a removable cap 16. As shown in FIG. 2, the collar 14 provides a drinking area devoid of threads, snaps or other contoured attachment elements to provide a more comfortable drinking surface, while the removable cap 16 selectively seals the opening in the bottle.

Figure 4:
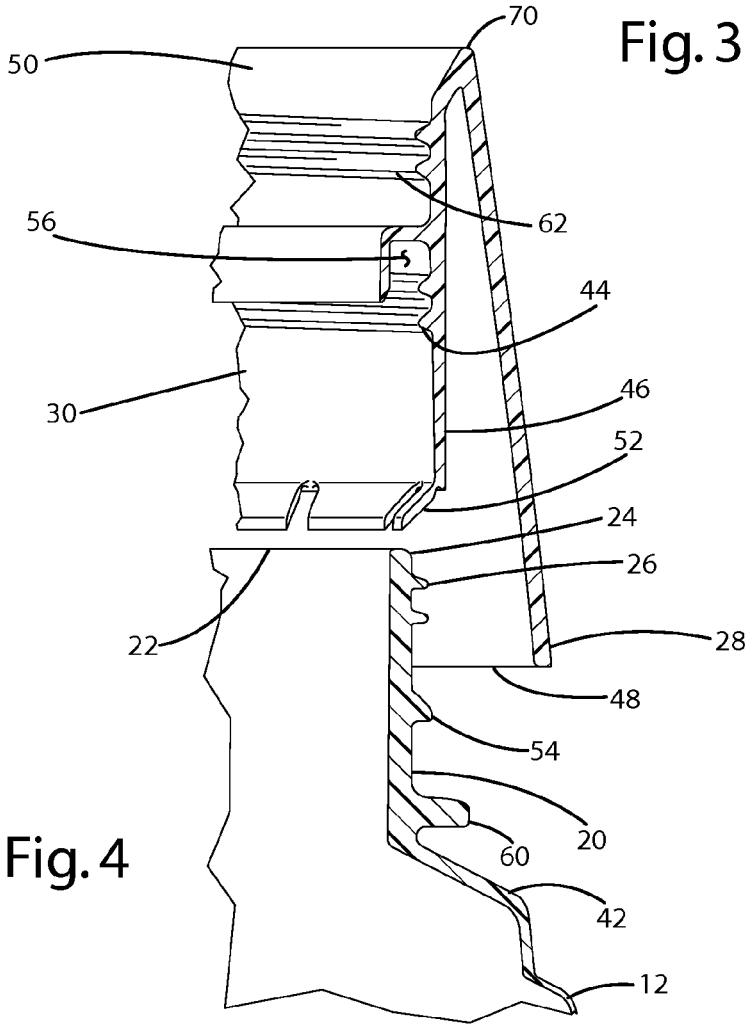
FIG. 4 is a sectional side view of the dispensing end of the drinking bottle assembly with the collar removed, taken along lines 3-3.

In the illustrated embodiment, the bottle 12 defines a cavity 18 for storing a fluid and includes a threaded neck 20 that forms an opening 22 at a dispensing end 24 of the bottle (FIG. 4). The collar 14 is connected to the bottle 12 at the neck 20 and forms a dispensing opening 50 from which a person can drink. The collar 14 at least partially covers the threaded neck 20, such that a person's mouth and/or lips engage a smooth, non-threaded outer drinking surface 28 of the collar 14, as opposed to the threaded neck 20 of bottle 12. The collar 14 includes a threaded neck attachment 44 on a surface 30, which may be any surface other than the drinking surface 28, for connecting the collar 14 to the threaded neck 20 for retaining the collar to the bottle 12. A removable cap 16 is provided for opening and closing the dispensing opening 50 and includes a threaded collar attachment 64 for selectively connecting the cap 16 to the collar 14.

The bottle 12 of the drinking apparatus 10 can be formed in any shape that is suitable for defining a chamber 18 for storing fluid. In the illustrated embodiment, the bottle 12 is generally cylindrical, with the central portion 34 having a slightly larger circumference than that of the upper portion 36 and lower portion 38. The bottle 12 also includes lengthwise indentations 40, which may be included for both aesthetic and functional purposes, as they may possibly allow a person to more easily grip the bottle. The bottle 12 further includes a generally flat base or bottom surface, such that the bottle can stand upright. The bottle 12 may optionally have a wall thickness in the range of approximately 0.5 mm.

The bottle 12 may be made from any suitable material using any appropriate manufacturing process, such as injection molding and blow-type molding, which are generally known in the art. In the illustrated embodiment, bottle 12 has been formed from blow molded plastic, which involves melting down the plastic and forming it into a preform, which is a tube-like piece of plastic with a hole at one end through which compressed air can pass. The preform is typically injection molded to form the tube and threaded neck portion. The preform is then clamped into a mold that is shaped to form the bottle 12, and compressed air is pumped into the preform, which forces the plastic out to match the mold. Once the plastic has cooled and hardened, the mold can be opened so that the the bottle can be ejected (process not shown).

The bottle 12 can be formed from any suitable material. For example, in an embodiment in which the bottle 12 is molded, the bottle 12 may be formed from any suitable, moldable material, such as flexible or semi-rigid plastics, including polyethylene terephthalate (PET). The bottle 12 may be formed from a clear or translucent material, such that the contents of the bottle are visible through the bottle 12. In embodiments in which the bottle is formed using other manufacturing processes, a variety of other materials, including glass and metal, can be used. The bottle 12 can contain any type of fluid, including beverages such as water, soda, juice and the like.

The neck 20 refers to the narrowed portion of the bottle 12 at the dispensing end 24 (FIG. 4). In the illustrated embodiment, the neck 20 has a generally round cross section and defines a narrow passage through which fluid from the cavity 18 flows before it exits the opening 22. In the illustrated embodiment, the neck 20 is shaped and sized similar to the neck portions of drinking bottles presently known in art, which are sized to allow a person to drink from the dispensing end 24. As shown in FIGS. 3-6, the bottle 12 includes a transition area 42, in which the diameter of the bottle begins to gradually narrow toward the neck 20. Both the transition area 42 and neck 20 can be any desired length.

In the illustrated embodiment, the neck 20 includes a set of threads 26 that are positioned on the outer surface of the neck 20, at or near the dispensing end 24 of the bottle. In the illustrated embodiment, the threads 26 correspond to the threads 44 on the inner surface 30 of the collar 14, such that the threads 26 and 44 can be interfitted to retain the collar 14 on the bottle 12. However, the neck 20 and collar 14 can be interfitted and/or retained together using any suitable connection elements, such as snap elements for providing a snap-fit connection. Alternately, the collar 14 can be sized to be press-fitted onto the neck 20.

Figure 5:
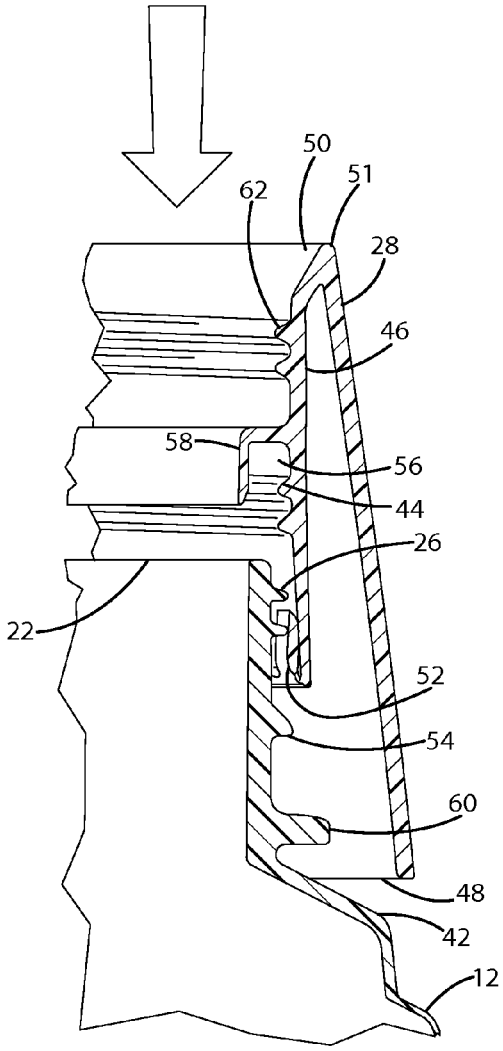
FIG. 5 is a sectional side view of the dispensing end of the drinking bottle assembly with the collar being applied to the bottle, taken along lines 3-3.

The collar 14 can be formed in any suitable shape to (a) connect to the bottle 12, (b) at least partially cover the connection elements on the neck 20, and (c) form dispensing opening 50. In the illustrated embodiment, the collar 14 includes an inner connecting portion 46 and an outer sidewall 48 that is spaced from the connecting portion 46 (FIGS. 4 and 5). In the illustrated embodiment, the threaded inner surface 30 of the collar 14 forms the inner surface of the attachment portion 46, and the non-threaded outer drinking surface 28 forms the outer surface of the sidewall 48. In the illustrated embodiment, the upper ends or edges of the sidewall 48 and attachment portion 46 meet to form dispensing opening 50, while a bottom edge of the sidewall 48 is spaced from a bottom edge of the attachment portion 46.

Figure 6:
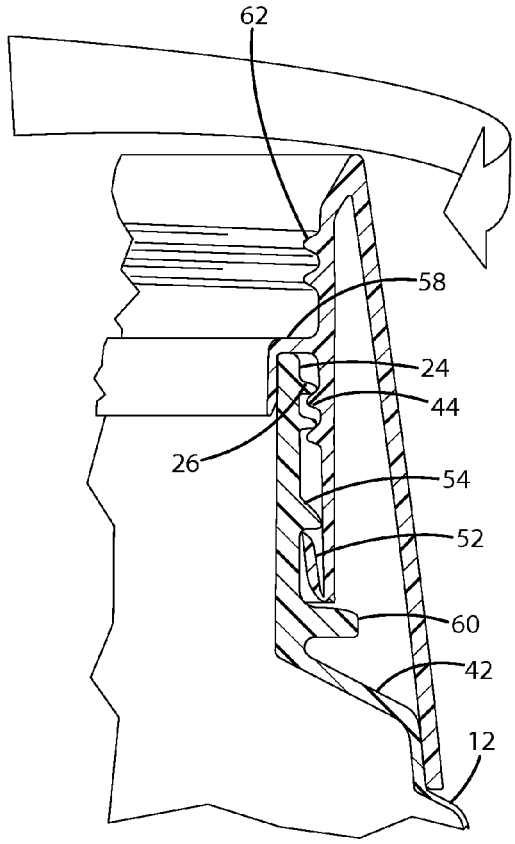
FIG. 6 is a sectional side view of the dispensing end of the drinking bottle assembly with the collar attached to the bottle, taken along lines 3-3.

As shown in FIGS. 5 and 6, the collar 14 is connected or attached to the bottle 12 by applying the collar 14 over the neck 20, such that the threaded inner surface 30 of the collar 14 can engage the threads 26 on the neck 20, and twisting the collar 14 about the neck 20 in a clockwise direction. The collar 14 can be twisted until it stops, at which point it is sealed to the bottle 12 at the threaded neck 20.

The threaded connection between the collar 14 and the neck 20 is sufficient to retain the collar on the bottle 12. However, the drinking bottle assembly 10 may alternatively or additionally include other features for retaining the collar 14 in place on the bottle. For example, in the illustrated embodiment, the collar 14 includes a plurality of tabs 52 that engage a lip 54 on the bottle 12 to resist the removal of the collar 14 from the bottle 12. The tabs 52 can provide a snap fit connection between the collar 14 and the bottle 12 that is sufficient to retain the collar 14 on the bottle 12 without the assistance of the interfitted threaded portions 26 and 44 discussed above. However, in the illustrated embodiment, the bottle assembly 10 includes both the threaded portions 26, 44 and the tabs 52.

Figure 7:
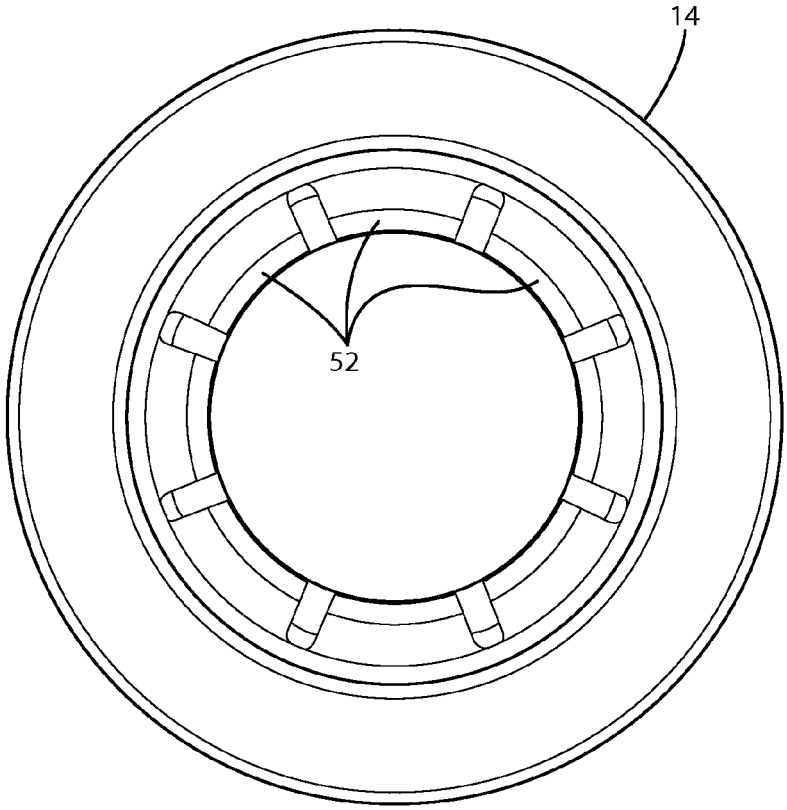
FIG. 7 is a bottom view of the collar.

In the illustrated embodiment, both the tabs 52 and the lip 54 are spaced about the entire circumference of the attachment portion 46 of the collar 14 (FIG. 7). To position the tabs 52 under lip 54, the tabs 52 must be pushed or pulled or otherwise forced over both the threads 26 of the neck portion 20 and the lip 54 when the collar 14 is applied to the bottle 12. In the illustrated embodiment, the tabs 52 are adapted to flex with respect to the connecting portion 46. Specifically, the tabs 52 flex from a first position, in which they extend generally inward from the inner surface 30, to a second position, in which they flex generally upward when they engage the threads 26 (see FIGS. 4 and 5). To enable the tabs 52 to flex from the first position to the second position, each of the tabs 52 may optionally be attached to the connecting portion 46 of the collar 14 by a living hinge.

In the illustrated embodiment, once the collar 14 reaches a position in which the tabs 52 have been pushed or pulled or otherwise forced over the threads 26, the threads 44 of the collar 14 are positioned to engage the threads 26 of the neck 20. The collar 14 can be twisted in a clockwise direction about the neck 20, which causes the collar to move or advance further down onto the neck 20, which in turn pulls the tabs 52 over the lip 54 (FIG. 6). Alternatively, the collar 14 can be pushed or pulled down over the neck 20 with enough force to allow the tabs 52 to travel over the lip 54, and to allow the threads 44 to travel over the threads 26, into a position in which they are interfitted with threads 26. In the illustrated embodiment, once the tabs have traveled over the lip 54, the tabs 52 flex or snap back against the bottle 12 (FIG. 6).

As previously noted, the tabs 52 function to resist the collar 14 from being removed from the bottle 12, even if the threads 44 become disengaged from the threads 26 of the neck 20. As shown in FIG. 6, when the collar 14 is attached to the bottle 12, an outer end of the tabs 52 engages the lip 54. If the collar 14 is twisted in a counter-clockwise direction or if the collar is pulled in a direction away from the bottle in an attempt to lift or remove the collar 14 from the bottle 12, the force of the tabs 52 against the lip 54 acts to resist the collar 14 from being removed. The tabs 52 may create a resistance force that is sufficient to deter a person from mistakenly removing the collar 14, yet able to be overcome if removal of the collar 14 is necessary or desired.

Optionally, the bottle 12 and collar 14 may include features to prevent the collar from being twisted or pressed too far onto the bottle, which may cause damage or stress to the drinking bottle assembly 10. For example, the collar 14 may include a flange 58 that extends from the inner surface 30 (FIGS. 5 and 6). In the illustrated embodiment, the flange 58 is generally L-shaped and faces generally downward to define pocket 56 for receiving the dispensing end 24 of the bottle 12 when the collar 14 is connected or sealed to the bottle 12. Once the dispensing end 24 of the bottle 12 reaches and engages flange 58, the force of the flange 58 against the bottle 12 resists further twisting or pressing of the collar 14 on or about the bottle 12.

Optionally, the flange 58 may also function to provide a positive seal against the bottle 12, such that fluid is prevented from leaking between the collar 14 and the bottle 12, and is instead forced to flow through the dispensing opening 50 formed by the collar 14. Optionally, the flange 58 may include a seal or O-ring for sealing the collar 14 against the bottle 12 (not shown).

To further prevent the collar 14 from being twisted or pressed too far onto the bottle 12, the bottle 12 includes an optional lip 60, positioned below the threads 26. As shown in FIG. 6, when the collar is connected to the bottle 12, the collar typically does not reach the lip 60. However, the lip 60 may be positioned close enough to the collar 14 that if the collar 14 were to be twisted or pressed too far about the bottle 12, the lip 60 could engage the a bottom end or edge of the connecting portion 46 to resist further twisting of the collar 14.

In the illustrated embodiment, when the collar 14 is connected to the bottle 12, the sidewall 48 of the collar 14 completely covers the threads 26 on the neck 20 and, thus, provides a smooth outer surface 28 that a person's mouth and lips can engage while drinking. This configuration not only increases comfort for the person drinking, but also provides an aesthetically pleasing drinking bottle. In the illustrated embodiment, the outer drinking surface 28 of the collar 14 is shaped to generally follow the contour of the bottle 12 (FIG. 2). However, the outer surface 28 may be shaped as desired to form a comfortable drinking surface. For example, the smooth outer surface 28 may alternatively be slightly indented to correspond to a person's lips.

To further increase the comfort for the person drinking, the edge 70 of the collar 14 at the dispensing opening 50 may be smooth and slightly rounded, as opposed to bottles known in the art, which typically include squared edges and seams from the molding process (see FIG. 5). In the illustrated embodiment, the collar 14 has been molded so as to prevent any molding inaccuracies from resulting in a rough spot or seam on the edge 70. Further, to provide a more even flow of fluid from the bottle 12, the collar 14 may be angled outward from the inner surface 30 of the connecting portion 46 to the dispensing opening 50.

In the illustrated embodiment, the collar 14 includes two separate connection elements on the inner surface 30: (a) a first set of threads 44, discussed above, that is formed to be interfitted with the threads 26 on the bottle neck 20, and (b) a second set of threads 62 that is formed to be interfitted with a threaded portion of the cap 16. Both of these connection elements are positioned internally on the collar 14, so as to prevent any contact between the connections elements and a person's lips or mouth. Although both of the connection elements on the collar 14 are shown in the illustrated embodiment as threaded portions, the collar 14 can be connected to the bottle 12 and the cap 16 in any suitable manner. Optionally, the collar 14 can be connected to the bottle 12 and the cap 16 in different manners. For example, the collar may be press-fitted or snap-fitted on the bottle, and the cap 16 may be threaded to correspond to a threaded portion on the collar 14, or vice versa.

In the illustrated embodiment, the threads 62 are positioned at or near the upper portion of the collar 14, near the dispensing opening 50 but on the inner surface 30 of the collar 14, so as to avoid contact with a person's mouth when drinking. In the illustrated embodiment, the threaded portion on the cap 16 is formed as a threaded insert 32, which can be dropped or otherwise inserted into the dispensing opening 50, such that threads 64 on the threaded insert 32 can easily engage the threads 62 on the collar 14.

To prevent the cap 16 from being twisted or pressed too far onto the collar 14, in the illustrated embodiment, the flange 58 on the inner surface 30 of the collar 14 is positioned between the first and second sets of threads 44 and 62. Thus, when a bottom edge or end of the threaded insert 32 engages the flange 58, the flange will provide a resistance force to resist further twisting or pressing of the cap 16 on or about the collar 14. The cap 16 can therefore be twisted about the collar 14 in a clockwise direction or pressed directly onto the collar 14 until it stops, at which point the cap 16 is sealed to the collar 14.

The connection between the cap 16 and the collar 14 provides a positive seal over the dispensing opening 50 to prevent the leakage of fluid from the bottle and to prevent dust, dirt and the like from entering the bottle. The cap 16 may be sealed to the collar 14 at any point of contact between the cap 16 and the collar 14, for example, at the flange 58 and at a point above the threaded connection. To further ensure a sealed connection between the cap 16 and the collar 14, a seal or O-ring may be provided at either of these locations or at another point of contact between the cap 16 and the collar 14 (not shown).

Figure 3:
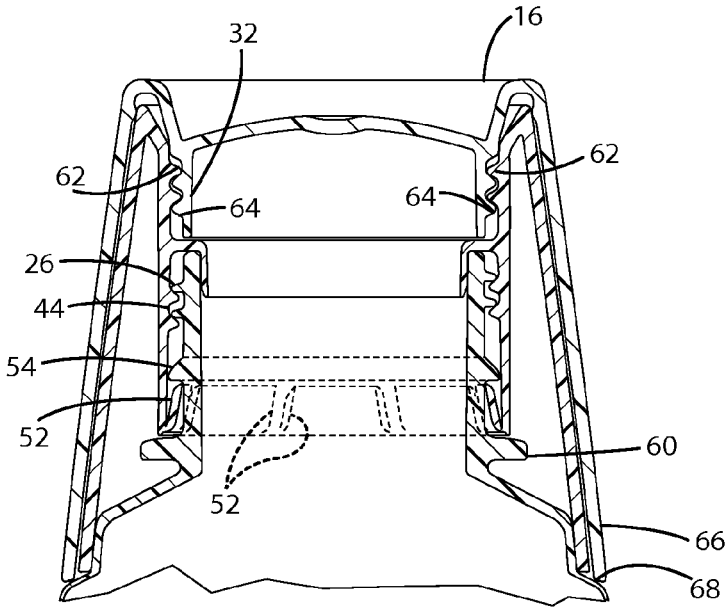
FIG. 3 is a sectional side view of the dispensing end of the drinking bottle assembly taken along lines 3-3.

In the illustrated embodiment, the cap includes an outer sidewall 66 for covering the collar 14. The outer sidewall 66 generally follows the contour of the bottle 12 and has a length that corresponds to that of the sidewall portion 48 of the collar 14. Optionally, and as shown in FIG. 3, the bottle 12 may form a ledge 68 for receiving the bottom edges of the sidewalls 48 and 66, such that the outer surface of the drinking bottle assembly 10 is generally smooth, even when the cap 16 and collar 14 are attached to the bottle 12. The ledge 68 may also assist in preventing both the collar 14 and cap 16 from being twisted or pressed too far about the bottle 12 and collar 14, respectively.

The collar 14 and the removable cap 16 may each be made from any suitable material using any appropriate manufacturing process, such as injection molding. Because of the details with respect to the threading on both the cap 16 and collar 14, the molding process may involve multiple moving cores, specifically, two moving cores for the cap and three for the collar. In such a configuration, different parts of the mold can be removed sequentially, to allow the threaded portions to be removed from the mold surfaces without stripping the threads.

When formed by a molding process, the collar 14 and cap 16 may be formed from a plastic, such as high density polyethylene (HDPE), which may be a natural or solid color, or may be translucent. Optionally, the collar 14 and cap 16 may be formed from a heavier, higher quality material than the bottle 12, to increase the structural rigidity and improve the texture of these portions of the drinking bottle assembly 10. Because both the cap 16 and the collar 14 may be repeatedly connected to and removed from the bottle 12 during use, these elements may require more structural rigidity than the bottle 12. Accordingly, the collar 14 and cap 16 may optionally have a wall thickness in the range of approximately 1.0 mm.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A bottle assembly from which a person drinks comprising:

a bottle defining a cavity for storing a fluid, wherein said bottle includes a neck that forms an opening at a dispensing end of said bottle, said neck including a first attachment portion;

a removable collar adapted to at least partially cover said first attachment portion on said neck, wherein said collar defines a dispensing opening and has an outer drinking surface and an inner surface, wherein a lower inner surface part of said inner surface includes a second attachment portion and an upper inner surface part of said inner surface includes a third attachment portion, said first attachment portion of said neck and said second attachment portion of said lower inner surface part being interfitted to removably connect said collar to said neck; and a removable cap for sealing said opening and adapted to cover the entire outer drinking surface, said cap including a fourth attachment portion adapted to be interfitted with said third attachment portion of said upper inner surface part to removably connect said cap to said collar.

2. The bottle assembly of claim 1, wherein said first, second, third and fourth attachment portions are threaded portions.

3. The bottle assembly of claim 2, wherein said collar includes a plurality of tabs that engage a lip on said bottle to resist the removal of said collar from said neck.

4. The bottle assembly of claim 3, wherein said tabs flex between a first position when said collar is not attached to said bottle and a second position when said collar is attached to said bottle.

5. The bottle assembly of claim 4, wherein said threaded portion of said inner surface of said collar is adapted to be twisted about said threaded portion of said neck to move said collar onto said neck and to pull said tabs over said lip.

6. The bottle assembly of claim 2, including a flange extending from said inner surface of said collar, wherein said flange is positioned between said second and third threaded attachment portions.

7. The bottle assembly of claim 6, wherein said flange forms a pocket for receiving said dispensing end of said bottle.

8. The bottle assembly of claim 6, wherein said cap is sealed to said collar at said flange.

9. The bottle assembly of claim 6, wherein said collar is sealed to said bottle at said flange.

10. The bottle assembly of claim 9, wherein said cap includes a sidewall that covers said collar.

11. The bottle assembly of claim 2, wherein said cap includes an insert adapted to be inserted into said dispensing opening, wherein said fourth threaded attachment portion is positioned on said insert.

12. The bottle assembly of claim 2, wherein said collar includes an inner connecting portion and an outer sidewall portion spaced from said connecting portion, wherein an upper end of said sidewall portion and an upper end of said connecting portion meet to form said dispensing opening.

13. The bottle assembly of claim 12, wherein said bottle is generally cylindrical.

14. A cap assembly for a drinking bottle from which a person drinks and having a neck that forms an opening at a dispensing end of said bottle, said cap assembly comprising:

a removable collar adapted to at least partially cover said neck of said bottle, wherein said collar includes a generally smooth outer drinking surface and an inner surface having a neck attachment for connecting said collar to said neck, said neck attachment on said collar is a first threaded portion adapted to be interfitted with a threaded portion on said neck, wherein said collar includes a connecting portion and an outer sidewall portion spaced from said connecting portion, wherein an upper end of said sidewall portion and an upper end of said connecting portion meet to form a dispensing opening; and a removable cap for sealing said opening and adapted to cover the entire outer drinking surface, said cap including a collar attachment for connecting said cap to said collar.

15. The cap assembly of claim 14, wherein said collar includes a second threaded portion adapted to be interfitted with a threaded portion on said cap.

16. The cap assembly of claim 15, including a flange extending from said inner surface of said collar, said flange being positioned between said first and second threaded portions.

* * * * *